US007484630B2

(12) United States Patent
Rose

(10) Patent No.: US 7,484,630 B2
(45) Date of Patent: Feb. 3, 2009

(54) DISPLAY RACK FOR TWO-PIECE BILLIARD CUES

(76) Inventor: Brian J. Rose, 3085 Knights Way, Doylestown, PA (US) 18901

( * ) Notice: Subject to any disclaimer, the term of this patent is extended or adjusted under 35 U.S.C. 154(b) by 220 days.

(21) Appl. No.: 11/062,718

(22) Filed: Feb. 22, 2005

(65) Prior Publication Data

US 2006/0186067 A1 Aug. 24, 2006

(51) Int. Cl.
*A47F 7/00* (2006.01)

(52) U.S. Cl. ..... 211/68; 211/85.7

(58) Field of Classification Search ..... 211/68, 211/60.1, 118, 70.8, 85.7, 66, 70.2, 189
See application file for complete search history.

(56) References Cited

U.S. PATENT DOCUMENTS

| | | | | | |
|---|---|---|---|---|---|
| 69,026 | A * | 9/1867 | Richmond | 211/68 |
| 1,132,190 | A * | 3/1915 | Kohout | 211/85.3 |
| 1,240,705 | A * | 9/1917 | Grode | 211/68 |
| 1,633,004 | A * | 6/1927 | Demers | 211/68 |
| 3,381,824 | A * | 5/1968 | Blumenschein | 211/68 |
| 4,079,839 | A * | 3/1978 | Winfree, Jr. | 211/68 |
| 4,343,404 | A * | 8/1982 | Folsom | 211/17 |
| 4,696,122 | A * | 9/1987 | Van Der Zyl | 43/21.2 |
| 5,067,621 | A * | 11/1991 | Alexander | 211/117 |
| 5,232,105 | A * | 8/1993 | Gregg | 211/113 |
| 5,588,542 | A * | 12/1996 | Winkler et al. | 211/70.8 |
| 5,947,583 | A * | 9/1999 | Castano | 362/132 |
| 6,039,420 | A * | 3/2000 | Besserer et al. | 312/265.1 |
| 6,102,217 | A * | 8/2000 | Mathy et al. | 211/85.7 |
| 6,976,595 | B1 * | 12/2005 | Geller | 211/94.01 |

* cited by examiner

*Primary Examiner*—Jennifer E. Novosad
(74) *Attorney, Agent, or Firm*—Armand M. Vozzo, Jr.

(57) ABSTRACT

An improved display rack for storing two-piece billiard cues comprises a support frame assembly attached to the front side of a back panel intended to be vertically disposed and adapted for mounting on a wall surface. The support frame assembly includes a base ledge member for supporting the butt section of each cue in a standing position and an upper ledge member formed with slotted openings to engage the collar end of each standing butt section, holding each butt section in substantially vertical position upon the base ledge member. A series of fasteners each adapted to releasably engage the collar end of the shaft section opposite to the cue tip are mounted beneath the upper ledge member to hold the shaft section of each cue in a substantially vertical and inverted attitude with the cue tip downward and suspended above the base ledge member that maintains the straightness of the shaft section and prevents warping of the cue while stored.

2 Claims, 5 Drawing Sheets

DISPLAY RACK FOR TWO-PIECE BILLIARD CUES

BACKGROUND OF THE INVENTION

The present invention relates to storage racks for billiard cues, and more particularly to an improved storage rack for displaying billiard cues of two-piece construction wherein the shaft section of the cue with the cue tip thereon is vertically suspended in an inverted position independent of the separately supported butt section to maintain straightness of the shaft section and prevent warping of the assembled cue.

In billiards, the straightness of the cue is vital to striking the cue ball properly and in the intended direction, with the least bit of bend or curvature in the cue raising the likelihood of a missed shot by sending the cue ball off of the intended line. For the recreational billiards player, a straight cue can improve shot-making skills and brings more enjoyment to the game. In the hands of an experienced player, especially one engaged in competition, a straight and linearly true cue is an essential instrument for successful performance.

There is a natural tendency for wooden cues to warp when not in use and left standing either unsupported or in storage racks. Although the wooden material of the cues may be treated to resist warping, the moisture normally found in the air, even in controlled interior environments, will cause the elongated shaft, particularly its slender, tapered portion to bow slightly with a curvature that renders the cue ineffective and in need of repair. In many cases, the warpage may be remedied and the bowed portion of the cue restraightened for effective use. In other cases, however, the warped cue cannot be completely straightened and is rendered essentially useless for competitive as well as recreational play. When the warpage affects the custom-made two-piece cues valued by serious players, the time and effort to restraighten the cue stick becomes painstaking and the cost of replacement becomes high.

While prior art devices have addressed the problem of warping cue sticks and provided various means for holding or suspending the single-piece cue from its tip in order to resist linear distortion, none have dealt with the similar warping problem that affects cues of two-piece construction when they are stored and not in use. Such two-piece cues, which generally have a slender, upper shaft section carrying the cue tip and a detachable lower butt section, are typically more expensive and highly-valued by players and, as a result, more costly and difficult to replace than one-piece cues. These two-piece cues, particularly their slender shaft sections, are as equally susceptible to warping and linear distortion as one-piece cues, and accordingly, there is a need for an improved means to store them in their separate sections without warping.

SUMMARY OF THE INVENTION

Accordingly, it is a general purpose and object of the present invention to provide an improved storage rack for two-piece billiard cues that is capable of supporting separate sections of the cues in a manner that prevents the cue sections from warping during storage.

A more particular object of the present invention is to provide an improved display rack for holding the separate shaft and butt sections of a two-piece billiard cue in association with each other when not in use and for an extended period of time without warping of the cue sections.

Another object of the present invention is to provide an improved support rack for holding the separable sections of a two-piece billiard cue so as to eliminate cue warpage as well as to promote straightening of bent cue sections. Still another object of the present invention is to provide an improved storage rack for displaying two-piece billiard cues in an elegant and easy to access manner.

A still further object of the present invention is to provide a display rack for two-piece billiard cues that is moderately sized, relatively inexpensive to construct and easily mounted to a selected wall surface.

Briefly, these and other objects of the present invention are accomplished by an improved display rack for storing two-piece billiard cues in their separable upper shaft and lower butt sections. The display rack comprises a support frame assembly substantially rectangular in its assembled form and attached to the front side of a back panel that is intended to be vertically disposed and adapted for mounting on a wall surface. The support frame assembly includes a base ledge member for supporting the butt section of each cue in a standing position and an upper ledge member formed with slotted openings over the base ledge member to engage the collar end of each standing butt section, holding each butt section in substantially vertical position upon the base ledge member. A series of clip fasteners each adapted to releasably engage the collar end of the shaft section opposite to the cue tip are mounted along the back panel and beneath the upper ledge member to hold the shaft section of each cue in a substantially vertical and inverted attitude with the cue tip downward and suspended above the base ledge member. Alternate fasteners employed in the present display rack are further disclosed for holding the shaft section of the cues in this suspended attitude that maintains the straightness of the shaft section and prevents warping of the cue when not in use.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

The following is a detailed description of a preferred embodiment of the present invention and the best presently contemplated mode of its production and practice. This description is further made for the purpose of illustrating the general principles of the invention but should not be taken in a limiting sense, the scope of the invention being best determined by reference to appended claims.

Figure 1:
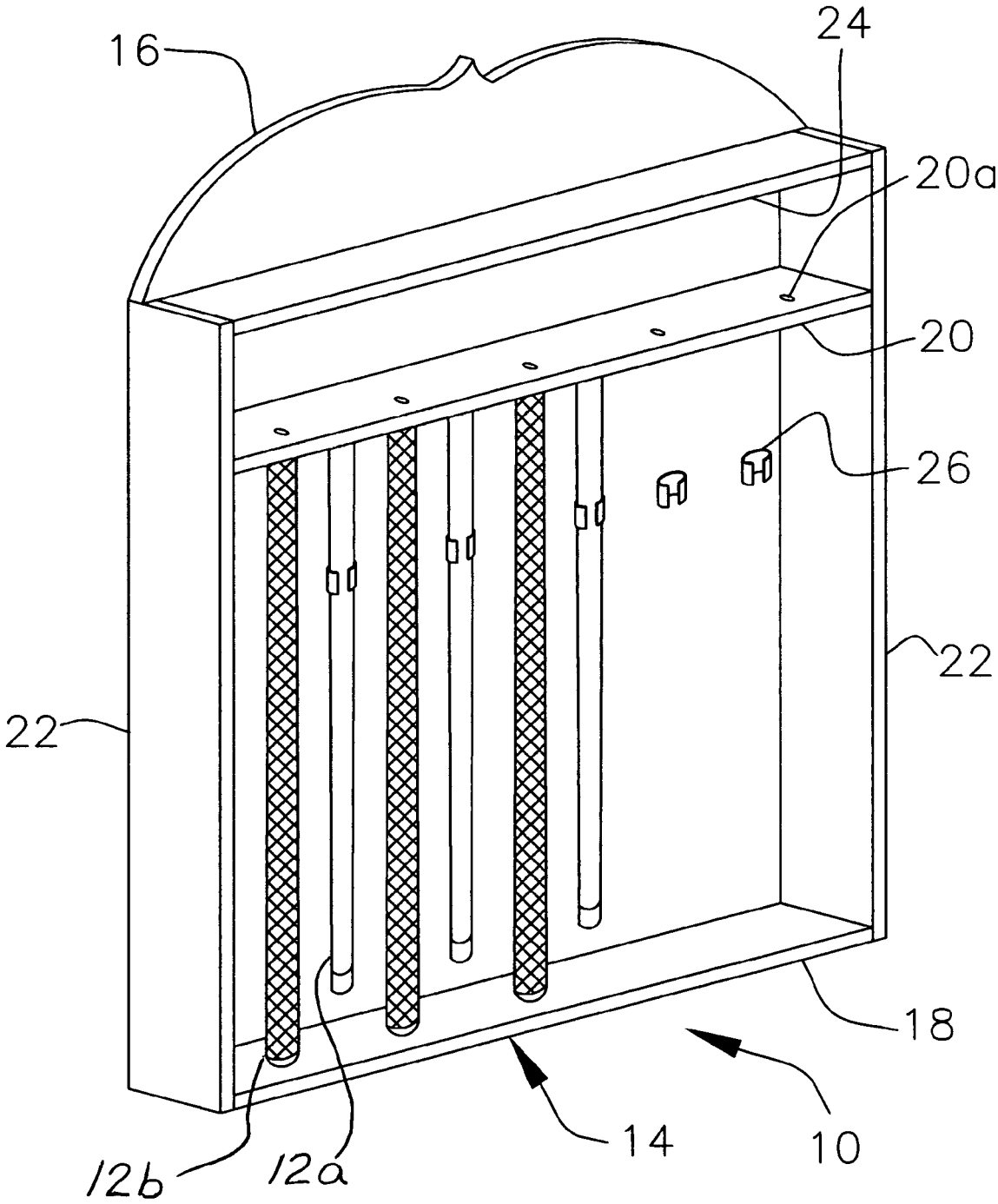
FIG. 1 is a front perspective view of a preferred embodiment of a display rack for two-piece billiard cues made in accordance with the present invention and shown holding sections of the two-piece cues stored therein.

Referring now to FIG. 1, a display rack, generally designated 10, is shown and presented herein for storing separate sections of a typical two-piece billiard cue construction, an upper shaft section 12*a* and a separable lower butt section 12*b* that are assembled together when in use. In the typical two-piece cue construction, the lower butt section 12*b* is a relatively thick member formed having a tapered cylindrical shape that reduces in its diameter from the bottom to the top or collar end of the butt section. The upper shaft section 12*a* is a relatively slender member also having a tapered cylindrical configuration that is reduced in its diameter from the bottom or collar end of the shaft section toward a cue tip 12*c* affixed at the opposite end or top of the shaft section. Both the upper shaft section 12*a* and lower butt section 12*b* are made of a relatively rigid lightweight material, typically a hardwood, and are adapted to be assembled together at respective mating ends on the top of the butt section and the bottom of the shaft section. The respective collar ends of the shaft section 12*a* and butt section 12*b* are made equal in their respective diameters and further adapted to be joined together using a threaded stud 12*d* affixed to and axially projecting from the collar end of the butt section to engage a mating chamber 12*e* or threaded insert provided in the collar end of the upper shaft. The present display rack 10 is intended to store together the separate shaft section 12*a* and butt section 12*b* of each two-piece cue when not in use and do so in such a way that prevents warping of the assembled cue, particularly its upper shaft section.

Figure 2:
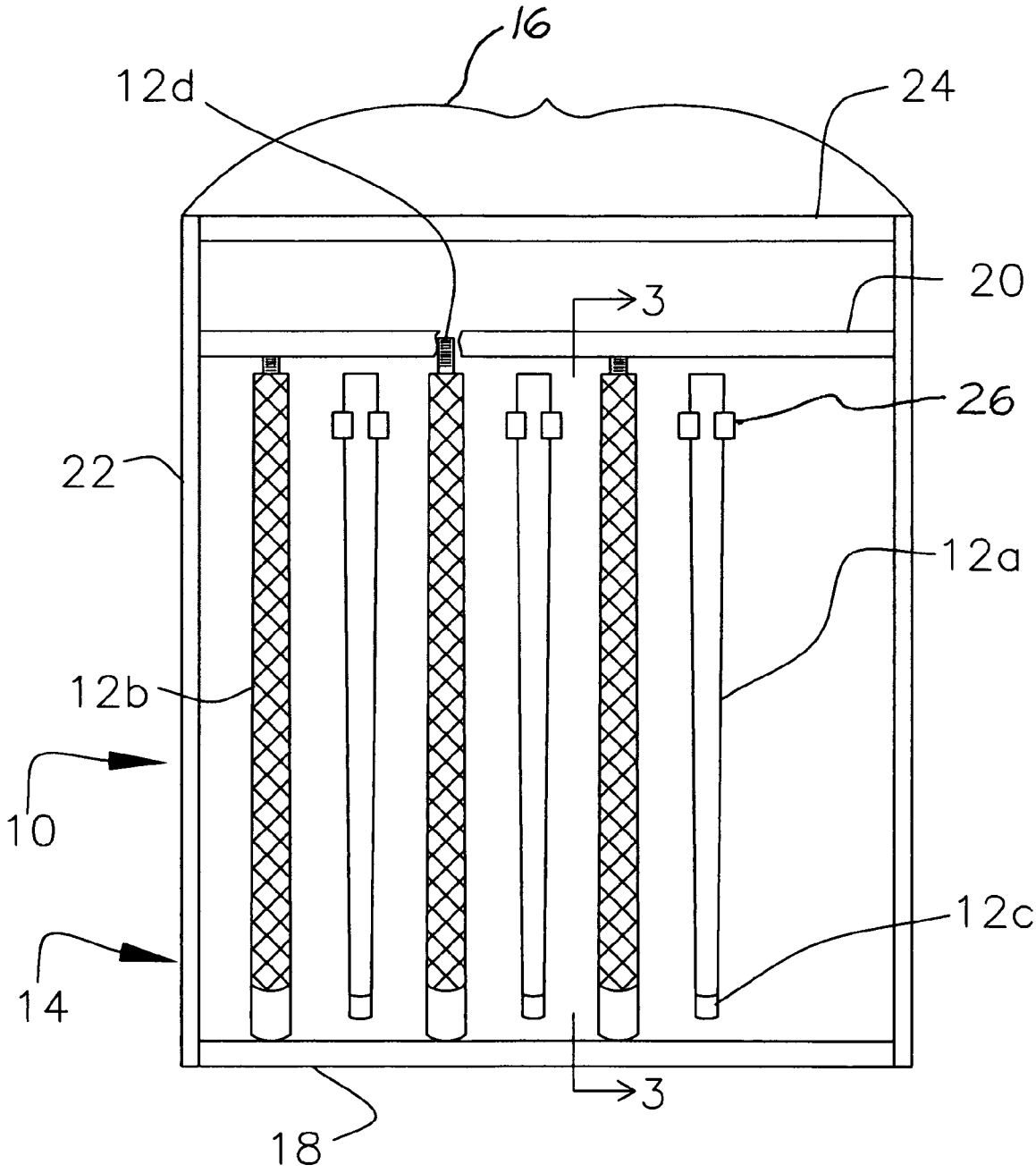
FIG. 2 is a front elevation view of the display rack of the present invention shown in FIG. 1.
Figure 3:
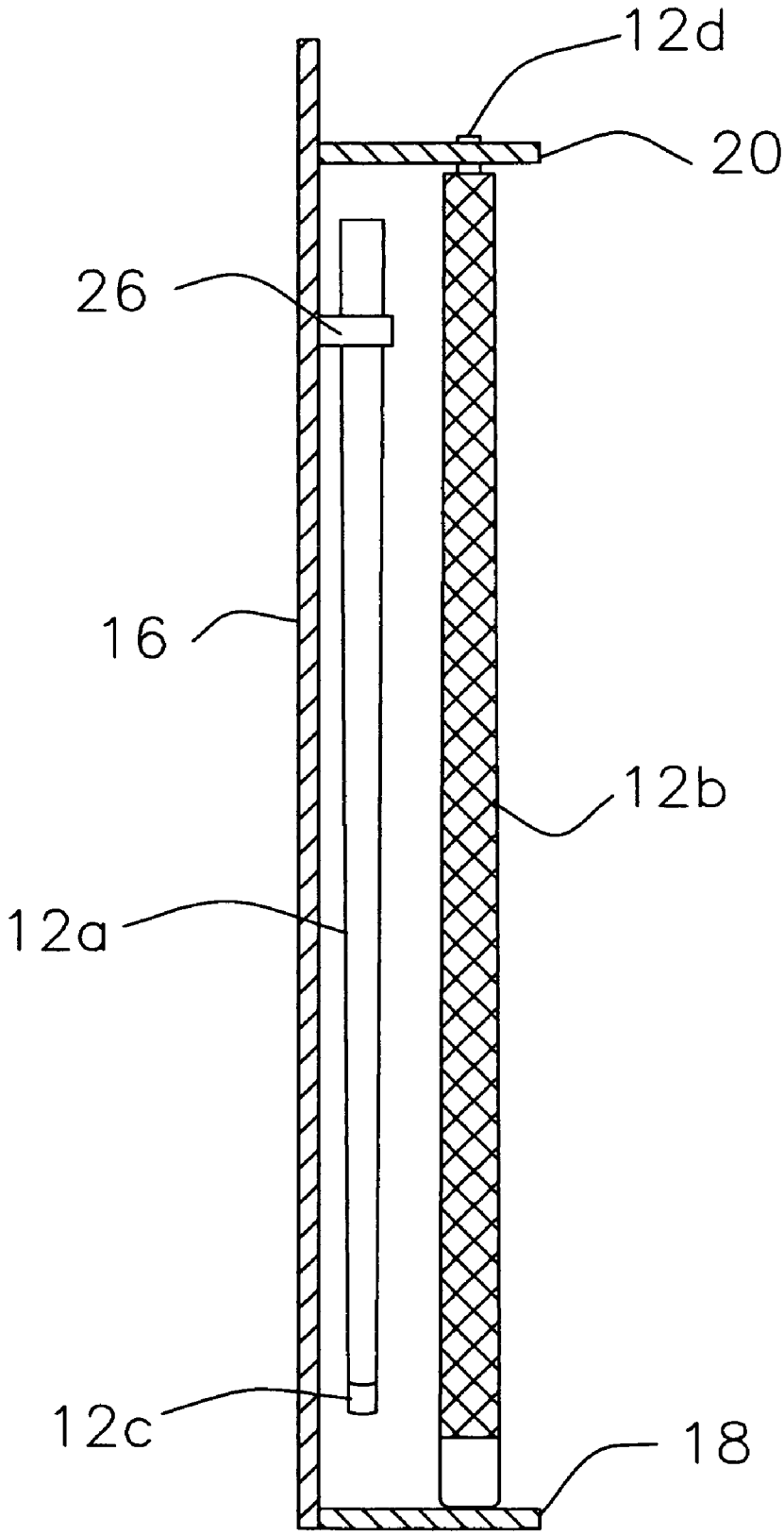
FIG. 3 is sectional view of the present display rack taken along the line 3-3 in FIG. 2.

Referring now to FIGS. 2 and 3 in conjunction with FIG. 1, the display rack 10 comprises a support frame assembly 14 that is substantially rectangular in its assembled form and attached to a back panel 16 so that the support frame projects forwardly from the back panel. The back panel 16 is a rigid and substantially flat member, preferably made of a wooden material, that is intended for mounting upon a wall surface and adapted to be hung vertically thereon in a level attitude using conventional mounting hardware (not shown). The back panel 16 may be generally rectangular in its perimeter form and have a curved ornamental profile at the top of the panel, as shown in the present drawing figures, but, alternatively can be formed in a variety of configurations within the scope of the present invention.

The support frame assembly 14 includes a base ledge member 18 extending in width and length across the bottom of the assembly, an upper ledge member 20 equal in width and length to the base ledge member and extending there over at a predetermined height, and a pair of side board members 22 disposed in parallel on opposite sides of the base and upper ledge members. All of the component members of the support frame assembly 14 are preferably made of a rigid, lightweight material, such as wood or plastic, and are connected to each other and attached to the back panel 16 using conventional means for securing attachment. The base ledge member 18 is formed having a relatively flat upper surface for supporting the butt section 12*b* of each cue in an upright standing position between the base ledge and the upper ledge member 20. The upper ledge member 20 is formed having a series of slotted openings 20*a* each made in the surface of the upper ledge and spaced apart along its length to engage the top of each respective butt section 12*b* supported upon the base ledge member 18. In particular, the slotted openings 20*a* are sufficiently sized and shaped to fit therein the threaded stud 12*d* that extends axially from the top of each butt section 12*b* so that the butt section is maintained in a substantially upright and vertical position within the support frame assembly 14 of the present display rack 10. A top edge panel 24 shown in the drawing figures disposed above the upper ledge member 20 and made to extend between the side board members 22 is added to the support frame assembly 14 to further provide the present display rack 10 with a ball storage compartment.

A series of clip fasteners 26 are spaced apart and mounted across the front of back panel 16 within the support frame assembly 14, each clip fastener being adapted to releasably engage the shaft section 12*a* of each cue in an inverted attitude near the collar end of the shaft section opposite from the cue tip 12*c*. The clip fasteners 26 are atttached to the back panel 16 beneath the upper ledge member 20 and at a level sufficiently above the base ledge member 18 to allow the full length of the inverted shaft section 12*a* to hang above the upper surface of the base ledge. The clip fasteners 26 may correspond in number to that of the slotted openings 20*a* in the upper ledge member 20 and in such a case, the clip fasteners may be mounted in alignment with the slotted openings so that the inverted shaft section 12*a* suspended therefrom will hang immediately behind its corresponding butt section 12*b* as seen in FIG. 3. Alternatively, the number of clip fasteners 26 can be more or less than the number of slotted openings 20*a* and in either case the mounted position of the clip fasteners 26 may be staggered relative to the position of the slotted openings.

Figure 4:
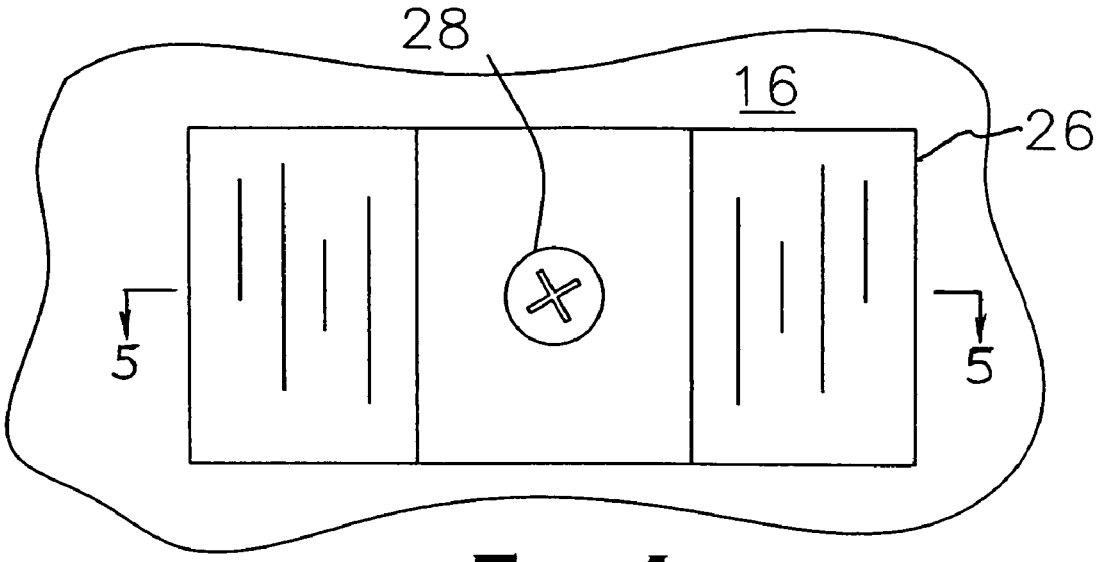
FIG. 4 is an enlarged frontal view of one of the clip fasteners mounted within the display rack shown in FIGS. 1-3.
Figure 5:
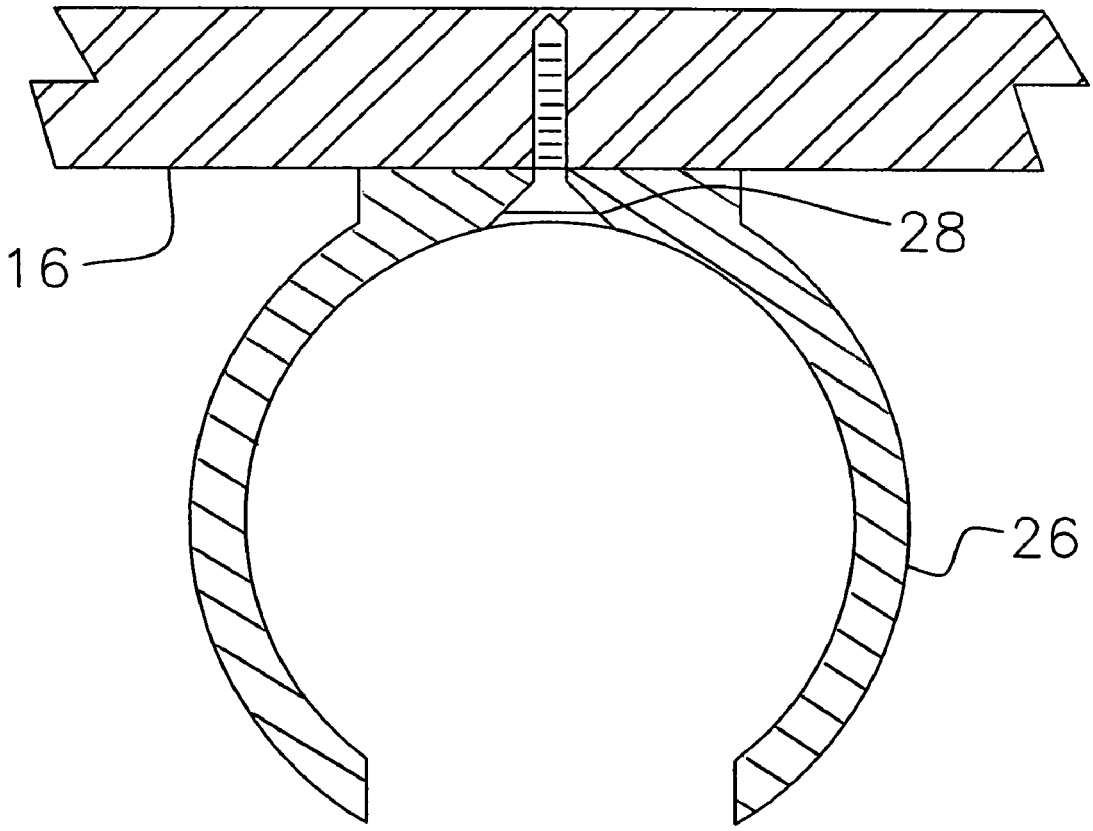
FIG. 5 is a sectional view of the mounted clip fastener taken along the line 5-5 in FIG. 4.

Referring now to FIGS. 4 and 5 in conjunction with FIGS. 1-3, each of the clip fasteners 26 is made from a resilient material, such as plastic, and is formed having a ring-like body with a substantially circular cross-section and a forward opening in its circumference to allow flexible expansion of the clip fastener during engagement and release of the shaft section 12*a* through the forward opening. The inner diameter of the clip fastener 26 approximates the typical diameter of the collar end of the shaft section 12*a* but is made smaller to permit the collar end of the shaft section in its inverted attitude to wedge closely within the ring-like body and suspend therefrom in a substantially vertical direction. It should be noted and understood that other curved configurations of the body of clip fastener 26, such as one of substantially elliptical cross-section sized to similarly fit the diameter of the collar end of shaft section 12*a*, will be effective in proper engagement of the shaft section and hold it in inverted suspension in accordance with the present invention. Each clip fastener 26 is secured in its mounting to the back panel 16 by conventional means such as with a standard screw 28 inserted centrally through the base of the clip fastener and into the back panel.

Figure 6:
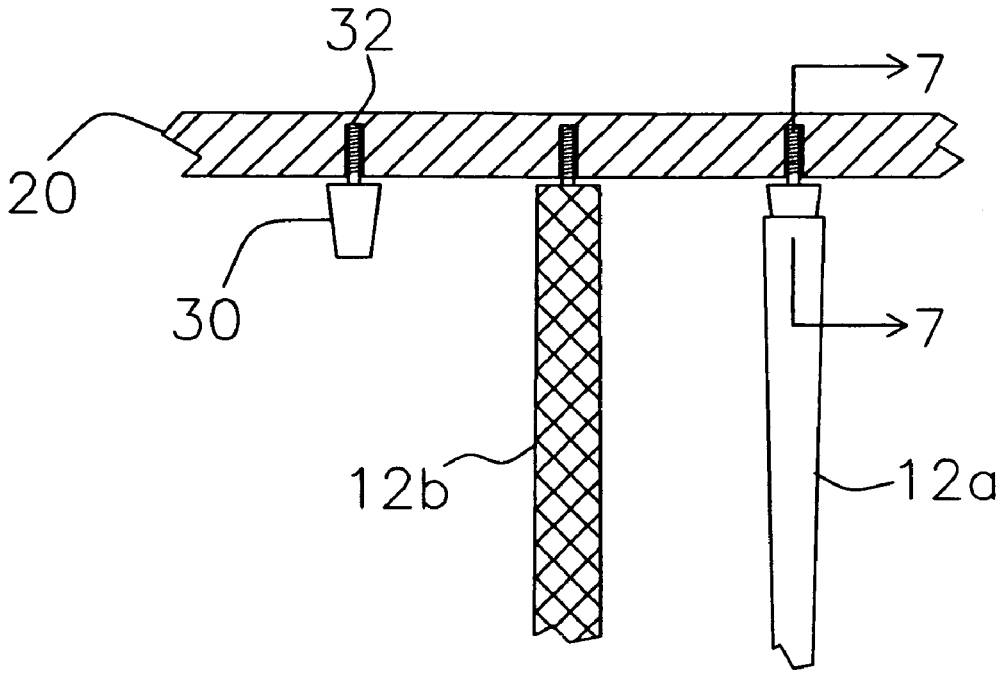
FIG. 6 is a partial front elevation sectioned along the top ledge member of the present display showing an alternate embodiment of the present invention for holding the shaft section of the cue in suspension.
Figure 7:
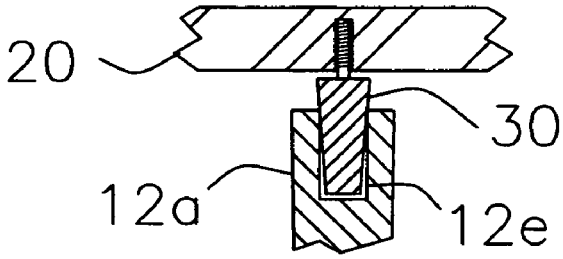
FIG. 7 is a cross-sectional view taken along the line 7-7 in FIG. 6.

Referring to FIGS. 6 and 7, an alternate fastener for engaging the collar end of the shaft section 12*a* and holding it in inverted suspension within the present display rack 10 is shown in the form of a tapered plug member 30. The plug member 30 has a tapered cylindrical body that is made of a soft and pliable material, such as rubber or plastic, sized so that its tapered end fits freely within the threaded chamber 12*e* typically formed in the collar end of the shaft section. Upon substantial insertion into chamber 12*e*, the expanding surface of the plug member 30 wedges firmly within the chamber to hold the shaft section 12*a* in suspension. In this alternate embodiment, the plug member 30 is mounted beneath the upper ledge member 20 upon a threaded stud 32 extending axially from the expanded end of the plug member so that the tapered end of the plug member is downwardly disposed and in position to engage the chamber 12*e* on the collar end of the shaft section 12*a*.

Figure 8:
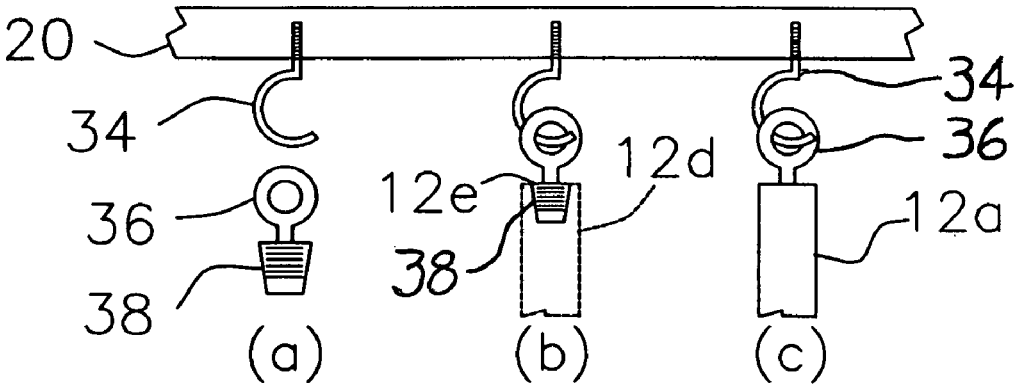
FIGS. 8(*a*)-(*c*) is a partial front view sectioned along the top ledge member of the display rack showing a further alternate means for suspending the shaft section of the cue in accordance with the present invention.

Referring to FIGS. 8(*a*)-(*c*), a further alternate means for vertically suspending the shaft section 12*a* within the present display rack 10 is a combination of a hook 34 adapted to be mounted beneath the upper ledge member 20 and a corresponding eye member 36 having a threaded stud 38 extending therefrom to engage the collar end of the shaft section. The hook 34 is a conventional hardware member formed having an integral threaded tip adapted to be secured into the upper ledge member 20 so that the hook depends directly beneath the upper ledge. The eye member 36 is sized and formed to engage the hook with the threaded stud 38 hanging freely therefrom. The threaded stud 38 is formed and adapted to fit within the mating chamber 12*e* so that it may be releasably engaged therein to provide a secure connection with the collar end of the upper shaft section 12*a*. The connection between the threaded stud 38 and the mating chamber 12*e* permits the shaft section 12*a* to be suspended when the eye member 36 is assembled to and engaged to the mounted hook 34.

Therefore, it is apparent that the described invention provides an improved display rack for storing two-piece billiard cues that is capable of supporting separate sections of the cues in a manner that eliminates the cue sections from warping during storage. The present invention further provides a display rack that stores the separate shaft and butt sections of a two-piece billiard cue together when not in use, particularly holding the shaft section in a suspended fashion that maintains its straightness over an extended period of time. The present display rack and its means for inverted suspension of shaft sections may also be used to help straighten previously warped or distorted cue sections. In addition to maintaining the separable sections of a two-piece billiard cue together without warping, the described invention serves to display the cues in an elegant and easy to access manner. Furthermore, the present display rack for two-piece billiard cues is moderately sized, relatively inexpensive to construct and easily mounted to a selected wall surface.

Obviously, other embodiments and modifications of the present invention will readily come to those or ordinary skill in the art having the benefit of the teachings presented in the foregoing description and drawings. Alternate embodiments of different shapes and sizes, as well as substitution of known materials or those materials that may be developed at a future time to perform the same function as the present described embodiment are therefore considered to be part of the present invention. For instance, hinged doors of glass or other material could be fitted and mounted upon the frame assembly and equipped with a lock for security and cleanliness. Accordingly, it is understood that this invention is not limited to the particular embodiment described, but rather is intended to cover modifications within the spirit and scope of the present invention as expressed in the appended claims.

What is claimed:

1. A display rack for storing one or more two-piece billiard cues each having a shaft section with a collar end and a cue tip opposite thereto and a corresponding butt section adapted to engage the collar end of the shaft section, comprising:

support frame means adapted to mount upon a wall surface for supporting the butt section of each cue in a standing position, said support frame means comprising a support panel adapted for mounting upon a wall surface, a lower ledge member connected to said support panel and disposed along the bottom thereof to support the butt section of each cue at the base thereof, and an upper ledge member connected to said support panel and disposed along said support panel above said lower ledge member, said upper ledge member being adapted to engage the top of the butt section of each cue so that the butt section may be held in substantially vertical position upon said lower ledge member; and fastener means coupled to said support frame means for suspending the shaft section of each cue from the collar end thereof so that the shaft section hangs alongside the standing position of the corresponding butt section in a substantially vertical and inverted attitude with the cue tip downwardly directed, said fastener means comprising at least one hook member mounted beneath said upper ledge member, and a corresponding eye member releasably engaged to the hook member, the eye member further having a threaded end for engaging the collar end of the shaft section.

2. A display rack for storing one or more two-piece billiard cues of the type having a shaft section with a collar end and a cue tip opposite thereto and a separate butt section adapted to engage the collar end of the shaft section, comprising:

frame means adapted to mount upon a wall surface for supporting the butt section of each cue in a standing position, said frame means comprising a lower ledge member connected to said support panel and disposed along the bottom thereof to support the butt section of each cue at the base thereof, and an upper ledge member connected to said support panel and disposed above said lower ledge member, said upper ledge member being adapted to engage the top of the butt section of each cue so that the butt section may be held in substantially vertical position upon said lower ledge member;

a support panel attached to said frame means and adapted for mounting upon a wall surface; and fastener means coupled to said frame means for suspending the shaft section of each cue from the collar end thereof so that the shaft section hangs alongside the corresponding butt section in a substantially vertical and inverted attitude with the cue tip downwardly directed, said fastener means comprising a plurality of hook members mounted beneath said upper ledge member, and a corresponding plurality of eye members each formed to be releasably engaged to a respective one of the hook members, each eye member further having a threaded end for engaging the collar end of the shaft section.

* * * * *